United States Patent [19]

Wraight

[11] Patent Number: 5,017,778

[45] Date of Patent: May 21, 1991

[54] METHODS AND APPARATUS FOR EVALUATING FORMATION CHARACTERISTICS WHILE DRILLING A BOREHOLE THROUGH EARTH FORMATIONS

[75] Inventor: Peter D. Wraight, Missouri City, Tex.

[73] Assignee: Schlumberger Technology Corporation, Houston, Tex.

[21] Appl. No.: 403,535

[22] Filed: Sep. 6, 1989

[51] Int. Cl.[5] ..... G01V 5/12

[52] U.S. Cl. ..... 250/254; 250/256; 364/422

[58] Field of Search ..... 250/254, 256, 266, 269, 250/261, 265; 364/422

[56] References Cited

U.S. PATENT DOCUMENTS

| | | | |
|---|---|---|---|
| 4,596,926 | 6/1986 | Coope | 250/254 |
| 4,665,486 | 5/1987 | Schultz | 364/422 |
| 4,705,944 | 11/1987 | Coope | 250/254 |

*Primary Examiner*—Jack I. Berman
*Assistant Examiner*—Richard Hanig
*Attorney, Agent, or Firm*—E. R. Archembeau, Jr.; John J. Ryberg

[57] ABSTRACT

The MWD methods and MWD apparatus disclosed herein include methods and apparatus for rotating a directionally-responsive radiation sensor having an outwardly-directed response axis in a borehole. These MWD methods and MWD apparatus further includes methods and apparatus for obtaining a series of successive measurements representative of a geometrical parameter of the borehole as well as a characteristic of the adjacent earth formations as the sensor scans circumferentially-spaced locations on the walls of a borehole interval. Methods and apparatus are provided for determining the means of the successive measurements as well as the standard deviation of the successive measurements and then combining these computations for providing output signals that are uniquely corrected in accord with variations in the traverse cross-sectional configuration of the borehole for providing indications representative of the desired formation characteristic as well as indications respresentative of the borehole configuration.

50 Claims, 3 Drawing Sheets

METHODS AND APPARATUS FOR EVALUATING FORMATION CHARACTERISTICS WHILE DRILLING A BOREHOLE THROUGH EARTH FORMATIONS

BACKGROUND OF THE INVENTION

This invention relates to methods and apparatus for measuring borehole parameters and formation characteristics while drilling a borehole through formations; and, more particularly, this invention pertains to new and improved methods and apparatus for measuring back-scattered nuclear radiation from adjacent formations to determine borehole parameters and characteristics of those formations while drilling a borehole that may have an irregular transverse cross-sectional configuration.

DESCRIPTION OF THE PRIOR ART

Those skilled in the art will appreciate that as an oil or gas well is being drilled it is essential to make successive measurements of one or more properties of the earth formations being penetrated by a drill bit as it progressively excavates the borehole. Heretofore, most of these measurements simply could not be obtained without temporarily removing the drill string and the drill bit from the borehole and conducting various so-called "wireline" logging operations in the borehole. Since wireline logging operations can significantly prolong the time needed to complete a given borehole, the usual practice heretofore has been to minimize as far as possible the number of so-called "open hole logs" that are run during the course of a drilling operation.

Those skilled in the art will, of course, recall that different proposals have been advanced heretofore for making one or more measurements of various formation characteristics without removing the drill string and bit from the borehole. By way of example, as fully explained in U.S. Pat. No. 3,112,442, it was proposed to provide a self-contained instrument having a recorder and electrical and radioactivity sensors that was lowered through the drill string and landed on an annular seat just above the drill bit. A series of measurements were taken and a so-called "wireline overshot" was then lowered through the drill string and coupled to an upright fishing neck on the instrument housing for returning the instrument to the surface for evaluation of the recorded measurements. A similar arrangement is shown in U.S. Pat. No. 3,209,323 which instead transmitted the measurements to the surface by way of a logging cable carrying an overshot with a winding that was inductively coupled to a matched winding on a fishing neck on top of the instrument housing. As shown in U.S. Pat. No. 3,186,222, another prior-art proposal employed a self-contained measuring assembly having electrical and/or radioactivity sensors that was mounted on the lower end of the drill string just above the bit. With this assembly, output signals were transmitted along the walls of the drill string to surface detectors by means of a set of self-contained repeater stations tandemly coupled at spaced intervals in the drill string as it was progressively assembled to lower the bit to the bottom of the borehole. It will be noted, however, that since these measuring assemblies had to be operated inside of the drill string, their sensors could measure only the natural gamma radiation from the formations being penetrated by the drill bit.

It will, of course, be appreciated by those skilled in the art that many of the operational problems experienced by such prior-art systems were effectively solved by the introduction of measuring-while-drilling or so-called "MWD" tools. With the MWD tools that are presently in use, real-time downhole measurements can now be transmitted to the surface without interrupting the drilling of a borehole. As described in greater detail in U.S. Pat. No. 3,855,857, for example, a typical commercial MWD tool may measure such downhole conditions as the weight-on-bit, torque acting on the bit, the inclination and azimuthal direction of the borehole, mud resistivity, borehole pressure and temperature as well as various characteristics of the earth formations that are being penetrated by the drill bit. The output signals of these downhole sensors are operatively coupled to a downhole computer that selectively drives an acoustic signaler in the MWD tool that successively transmits encoded data signals representative of these real-time measurements through the mud stream in the drill string to suitable detecting-and-recording apparatus at the surface. As an alternative, it has also been found useful with commercial MWD tools such as these to provide either a self-contained recorder or a downhole computer with sufficient memory for temporarily storing these measurements until such time that the drill string is taken out of the borehole such as, for example, when it becomes necessary to replace the drill bit.

It has also been proposed to arrange the MWD tools that are presently being used in commercial service to measure various radioactivity characteristics of the formations being penetrated by the drill bit. As was the case with the above-discussed self-contained retrievable instruments, there is no problem arranging MWD tools with typical gamma-ray detectors and circuitry for measuring natural gamma radiation. Typical MWD tools with this capability are seen, for example, in U.S. Pat. No. 4,520,468 as well as in FIG. 4 of U.S. Pat. No. 3,255,353. On the other hand, as illustrated in FIG. 1 of this last-cited patent, in order to measure other characteristics of earth formations using nuclear radiation, those MWD tools must also be provided with an appropriate source of radiation such as a radioactive chemical source. Since measurements of formation properties using nuclear radiation are significantly impaired by borehole fluids, as seen, for example, in U.S. Pat. No. 4,596,926 and U.S. Pat. No. 4,705,944 it was proposed some years ago that by arranging three pairs of collimated radioactive sources and gamma-ray detectors in a symmetrical array around the body of a MWD tool, the adverse effects of the borehole fluids surrounding the tool body would be "averaged out" so that the formation density could hopefully be determined.

The fundamental operating principle of these two last-mentioned MWD tools was, however, apparently quickly found to be at least inadequate if not inoperable inasmuch as U.S. Pat. No. 4,698,501 (which was subsequently issued to the common assignee of those two patents) concluded that it had been erroneous to assume that collimated beams of gamma-ray radiation would only interact with a precisely definable portion of the formation surrounding the borehole. To correct this observed error, it was proposed in this latter patent to arrange at least two gamma-ray detectors on diametrically-opposite sides of the tool body so as to be capable of measuring formation density without regard to the relative position of the MWD tool in the borehole. With this disclosed tool geometry, it is asserted that suitable formation density measurements can be obtained without either deploying the tool body against the wall of the borehole or employing radiation collimation to direct the radiation beam to a selected portion of the surrounding earth formations. Since the thrust of the latter patent was to provide a MWD density-measuring tool which would be in contact with the borehole wall as little as possible, it was considered essential to condition the accuracy of the subsequent formation density measurements on the fundamental assumption that the borehole will have a constant known diameter and have relatively few washouts in its side walls as the borehole is being drilled in order to facilitate making corrections for the density of the drilling fluid and the formation cuttings in the borehole annulus surrounding the tool. It will be appreciated, however, that since the bottom hole conditions are unpredictable, it has been considered difficult heretofore to consistently obtain accurate formation density measurements with MWD tools.

OBJECTS OF THE INVENTION

Accordingly, it is an object of the present invention to provide new and improved methods and apparatus for accurately measuring a selected characteristic of earth formations as they are penetrated during the course of a drilling operation as well as measuring geometrical parameters of the borehole.

It is a further object of the invention to provide new and improved MWD logging methods to make measurements which are representative of the back-scattered nuclear radiation returning from adjacent formations for determining characteristics of the earth formations penetrated by a borehole and correcting these measurements in keeping with the geometry of the borehole.

It is an additional object of the present invention to provide new and improved MWD logging apparatus arranged to be rotated in a borehole during a typical drilling operation for obtaining real-time measurements of the back-scattered nuclear radiation returning from the adjacent formations and correcting those measurements to compensate for irregularities in the borehole walls as well as to compensate for any significant variations in the borehole diameter which may be encountered in the course of the drilling operation.

SUMMARY OF THE INVENTION

These and other objects of the present invention are attained by new and improved MWD apparatus having a body with at least one outstanding member and including a radiation sensor cooperatively arranged to be directionally responsive along an outwardly-directed response axis. The MWD apparatus further includes data-acquisition means coupled to said radiation sensor for obtaining a series of successive measurements representative of at least one characteristic of the adjacent earth formations as the sensor scans circumferentially-spaced locations on the walls of a borehole interval. The invention further includes data-correlating methods and apparatus for determining the mean as well as the standard deviation of the successive measurements and combining the resulting mean and standard deviation for providing output signals that are uniquely corrected in accord with variations in the transverse cross-sectional configuration of the borehole for providing indications representative of the selected characteristic as well as indications representative of the actual borehole configuration.

BRIEF DESCRIPTION OF THE DRAWINGS

The particular features of the invention are set forth in the appended claims. The physical arrangement and methods of the present invention together with further objects and various advantages thereof may best be understood by way of the following description of exemplary apparatus incorporating the principles of the invention as depicted in the accompanying drawings, in which:

DESCRIPTION OF A PREFERRED EMBODIMENT

Figure 1:
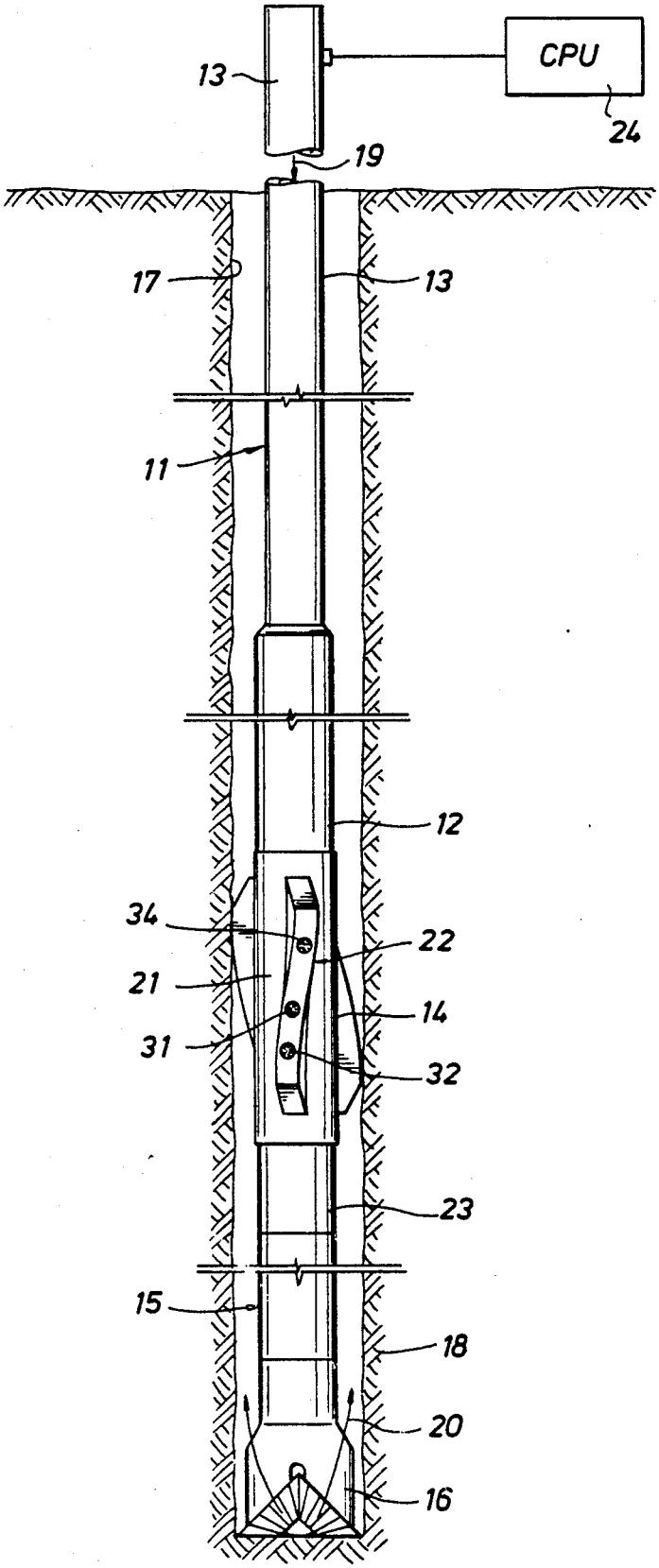
FIG. 1 schematically depicts a preferred embodiment of a MWD tool including the apparatus of the present invention as this tool is operated during the course of a drilling operation in a borehole.

Turning now to FIG. 1, a preferred embodiment of a new and improved density-measuring apparatus 10 incorporating the principles of the present invention is shown dependently coupled to the lower end of a drill string 11 comprised of one or more drill collars, as at 12, and a plurality of tandemly-connected drill pipe joints as at 13. As depicted, the new and improved MWD apparatus 10 includes a tubular body 14 which is coupled to the upper end of a MWD tool 15 that is in turn coupled to a drill 16 for excavating a borehole 17 through earth formations as at 18. As is customary, once the drill bit 16 has reached the bottom of the borehole 17, the drill string 11 is rotated by a typical drilling rig (not shown in the drawings) at the surface while substantial volumes of a suitable fluid such as a so-called "drilling mud" are continuously pumped downwardly through the drill string (as shown by the flow arrow 19). This drilling fluid is discharged from multiple ports in the drill bit 16 to cool the bit as well as to transport formation materials removed by the bit to the surface as the drilling mud is being returned upwardly (as shown by the flow arrow 20) by way of the annular space in the borehole 17 outside of the drill string 11.

In FIG. 1 it will be seen that the tubular body 14 of the new and improved MWD apparatus 10 is preferably adapted to be tandemly coupled between the MWD tool 15 and the lower end of the drill string 11. It will be noted that the new and improved MWD apparatus 10 further includes a body, as shown generally at 21, cooperatively arranged on the mid-portion of the tool body 14 and having an enlarged portion that is projecting toward at least one sidewall of the borehole 17. Although the specific configuration and materials of the enlarged body 21 are wholly incidental to the overall purposes of the invention, as a matter of convenience it has been found that a drill collar stabilizer having two or three generally-helical or straight blades, such as the selected blade shown at 22, (preferably of steel) can be readily arranged to provide the enlarged body. It should also be appreciated that by arranging the enlarged body 21 as a full-gauge stabilizer with multiple circumferentially-spaced blades, such as at 22, the flow area collectively defined between the outstanding blades is more than sufficient for accommodating the stream 20 of the drilling fluid that is flowing upwardly along the annular space defined in the borehole 17 around the drill string 11.

In the practice of the present invention, the diameter of the multi-bladed stabilizer 21 which is to be used during a particular drilling operation is chosen so that the diameter of a circle circumscribed around the outward edges of the stabilizer blade 22 and its companions will be about 0.50-inch smaller than the diameter of the drill bit 16 being used for drilling a given borehole, with the ideal being that the circumscribed diameter of the stabilizer is in the order of about 0.20-inch smaller than the outer diameter of the drill bit. This close spacing between the outward edges of the several blades, such as the selected blade 22, and the borehole wall surfaces will significantly minimize any tendency for the lower portion of the drill string 11 to "wobble" or move laterally in the borehole 17. It will be appreciated, therefore, that the outside diameter of the chosen stabilizer will depend upon the intended diameter of the borehole interval that is being drilled. Accordingly, as will be later explained in more detail, when the MWD apparatus of the present invention is to be operated in a large borehole it is preferred to arrange the tool body 14 as a large-diameter body which has a number of integral outstanding stabilizer blades, as at 22, which are uniformly spaced around the circumference of the tool body. On the other hand, for operations in smaller boreholes, it is preferred to arrange the MWD apparatus 10 with a smaller tool body 14 and instead employ a typical split-body stabilizer for the outer body 21 which can be mounted on the smaller tool body 14 and clamped into position. Typically, a number of modified multi-bladed stabilizers of different diameters will be needed for adapting the smaller tool body 14 to operate in different sizes of boreholes, with the choice of the stabilizer 21 that is to be used at any given time being wholly dependent upon the intended borehole diameter for that drilling operation.

As depicted in FIG. 1, the MWD tool 15 is arranged as an assembly of thick-walled tubular bodies enclosing sensors and circuits (not shown in FIG. 1) for measuring various downhole conditions such as the condition of borehole fluids as well as selected properties or characteristics of the formations 18 that have been penetrated by the drill bit 16. Although other means can, of course, be employed to transmit the various measurements to the surface, the MWD tool 15 further includes data-signalling means 23 cooperatively arranged for receiving output signals from the several measuring sensors and for successively transmitting encoded acoustic signals representative of these output signals to the surface where the acoustic signals are detected and then processed by appropriate signal detecting and data-processing surface apparatus as shown generally at 24. The data-signalling means 23 and (except as subsequently described by reference to FIG. 5) the signal detecting and data-processing apparatus 24 are arranged as the downhole and surface apparatus disclosed in U.S. Pat. No. 4,479,564 or in U.S. Pat. No. 4,637,479 which are respectively incorporated herein by reference.

Figure 2:
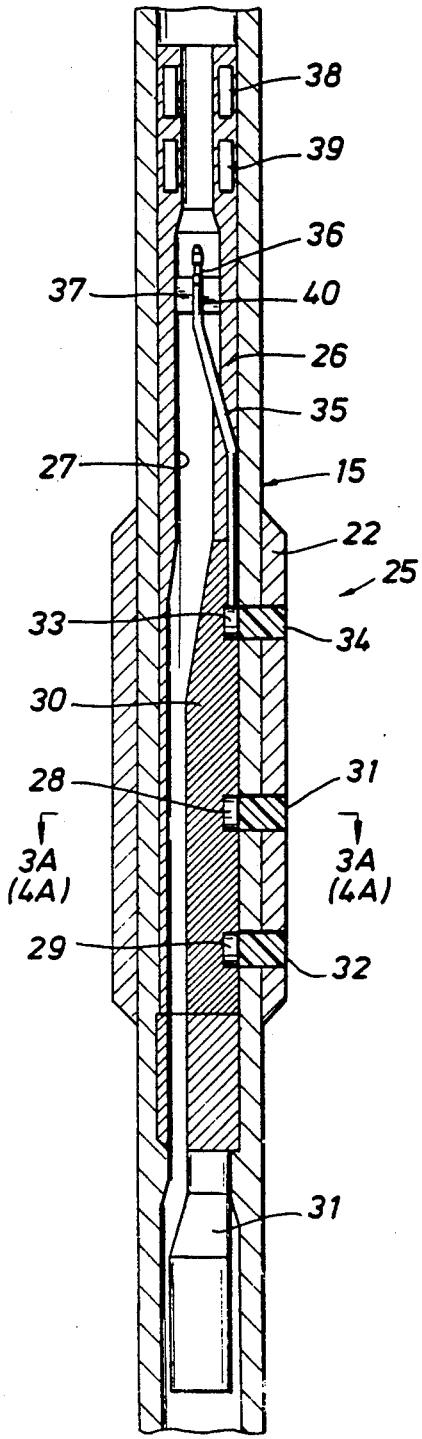
FIG. 2 is an enlarged view of the lower portion of the MWD tool shown in FIG. 1 for illustrating the arrangement of a radiation sensor employed in the practice of the invention as well as depicting the lower portion of the MWD tool within a borehole interval having a non-uniform cross-section or shape.

The MWD apparatus 10 of the invention further includes typical radioactivity logging means 25 located in the MWD tool 15 above the data-signalling means 23 and arranged as described in considerable detail in U.S. Pat. No. 4,814,609 issued to the present inventor as well as in a publication by him and others entitled "Combination Formation Density and Neutron Porosity Measurements while drilling" which was presented at the annual SPWLA meeting held in Denver, Colo., on Jun. 12, 1989, each of which are hereby incorporated herein by reference. As depicted in FIG. 2 hereof, an elongated tubular body 26 is mounted in the mid-portion of the tool body 14 and arranged with an offset flow passage 27 for carrying drilling fluid flowing through the tool string 11 and the tool body 14.

With the smaller size tool body 14, typical gamma-ray detectors 28 and 29 are enclosed in a fluid-tight chamber and respectively disposed in upper and lower longitudinally-spaced recesses in a suitable radiation shield 30 which is cooperatively positioned along one side of the inner body 26 so as to face these recesses outwardly away from the offset flow passage 27. The radiation detectors 28 and 29 are preferably coupled to suitable electronic circuitry fluidly sealed in a fluid-tight chamber or so-called "cartridge" 31 that is dependently supported in the tool body 14 below the radiation shield 30. It will, of course, be recognized by those skilled in the art that it is preferable to position the radiation detectors 28 and 29 as close as possible to the surface of the borehole 17. Accordingly, to practice the present invention in a situation that requires the tool body to be larger in diameter than the tool body 14 depicted in the drawings, this larger tool body is instead provided with a set of integral circumferentially-spaced stabilizer blades, as 22; and the radiation detectors, as at 28 and 29, are disposed in fluid-sealed chambers in the selected stabilizer blade 22.

It should also be appreciated that the two radiation detectors 28 and 29 do not necessarily have to be operated in the same manner. For instance, in the preferred embodiment of the MWD apparatus 10 and as will subsequently be described in greater detail, the gamma-ray detector 28 is arranged in keeping with the principles of the invention for determining the corrections which must be made for irregular borehole configurations and the other detector 29 is employed for making the conventional corrections such as, for example, the traditional spine-and-rib correction in a manner such as the correction described in the above-referenced SPWLA publication by the present inventor. Alternatively, one or both of the detectors 28 and 29 could also be selected to respond to other forms of nuclear events such as, for example, neutrons. Those skilled in the art will further note that, in any event, in designing a commercial MWD tool utilizing the principles of the present invention, practical constraints must be considered such as, for example, the available downhole memory and the bandwidth limitations existing in any mud pulse transmission system.

In keeping with the principles of the invention that is fully described in the aforementioned U.S. Pat. No. 4,814,609, the radiation shield 30 is angularly positioned within the inner body 26 so that with the smaller-diameter tool body 14 depicted in the drawings, the longitudinally-spaced recesses in front of the upper and lower detectors 28 and 29 are respectively facing upper and lower openings respectively arranged in the side wall of the tool body 14 and cooperatively aligned with corresponding upper and lower lateral openings provided in the selected blade, such as at 22, of the stabilizer 21. To exclude mudcake and other borehole materials from these openings, the openings in the blade 22 of the stabilizer 21 are respectively sealed by plugs 31 and 32 of radiation-transparent materials. As fully described in the last-mentioned patent, the radioactivity logging means 25 preferably include an encapsulated source 33 of gamma-ray energy that is removably disposed in an upwardly-opening chamber located in the sidewall of the inner body 26 a short distance above the upper detector 28 and immediately adjacent to a lateral opening in the body 14 that is fluidly sealed by a plug of a suitable radiation-transparent material 34.

To enable the radiation source 33 to be retrieved while the MWD apparatus 10 is coupled to the drill string 11, the encapsulated radiation source is dependently coupled to the lower end of an elongated flexible mandrel or relatively-stiff cable 35 having a fishing neck 36 on its upper end. As described in the last-mentioned patent, the upper end of the cable 35 is centered by a central member 37 that is coaxially mounted in the upper portion of the inner body 26. Neutron-responsive detectors 38 and 39 and a neutron radiation source 40 are operatively arranged in the upper portion of the inner body 26 for making measurements representative of the neutron porosity of adjacent formations. Nevertheless, inasmuch as the preferred embodiment of the present invention which is disclosed herein is directed to the new and improved density-measuring methods and the MWD apparatus 10 shown in the drawings, it will be seen that the present invention is wholly independent of other measurement devices that might also be incorporated into the MWD apparatus; and, accordingly, a full and complete understanding of the present invention does not necessitate descriptions of other apparatus or methods that might be employed in conjunction with the invention.

Figure 3A:
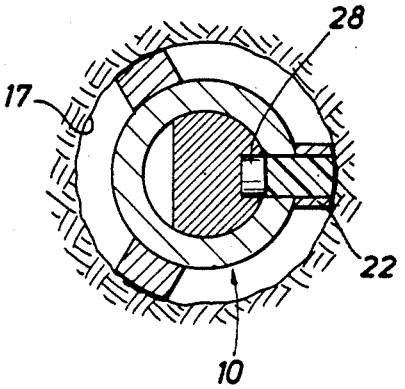
FIG. 3A is a cross-sectioned plan view of the MWD tool and the borehole respectively taken along the Lines A—A in FIG. 2 for illustrating the MWD tool as it is rotated in an interval of the borehole which has a circular transverse cross-section.
Figure 3B:
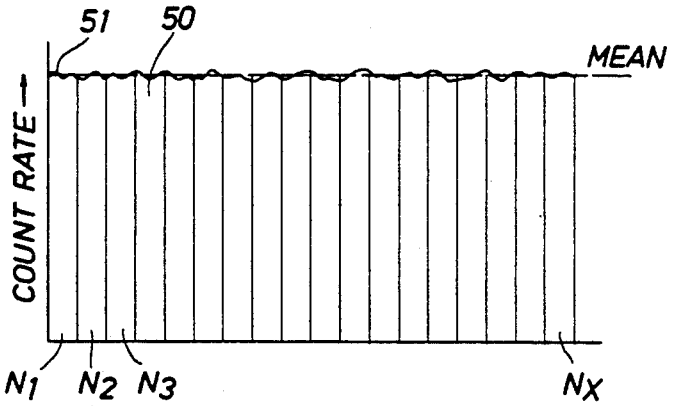
FIG. 3B graphically depicts count rate measurements as will be typically produced by the radiation sensor as it is rotated to successive angular positions in the circular borehole interval shown in FIG. 3A during the practice of the invention.
Figure 3C:
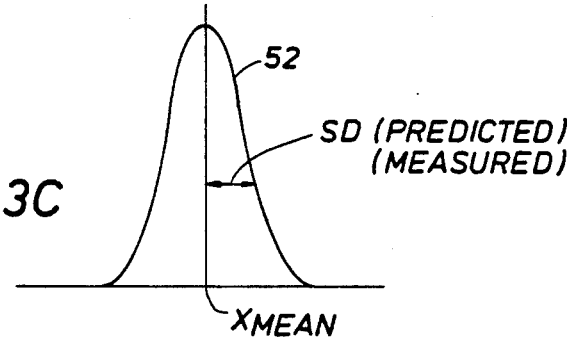
FIG. 3C graphically portrays the distribution of the count rates that might normally be expected in the practice of the invention whenever the MWD tool is rotating in the circular borehole depicted in FIG. 3A.

Turning now to FIGS. 3A–3C of the drawings, FIG. 3A is a cross-sectional view of the density-measuring apparatus 10 taken along the Lines A—A of FIG. 2 for schematically depicting the tool as it is rotated in a substantially-circular borehole interval which has a uniform diameter only slightly larger than the circle of revolution defined by the outer edges of the multi-bladed stabilizer 21. Inasmuch as the practice of the invention is independent of borehole inclination, it will be appreciated that FIG. 3A illustrates a typical situation whenever the MWD apparatus 10 is operating in any substantially-circular borehole interval regardless of whether that interval is vertical or is steeply inclined away from the vertical. Accordingly, if the depicted interval of the borehole 17 is vertical, the edges of the three blades of the stabilizer 21 are shown as being in close proximity, if not in actual engagement, with spatially-disposed wall surfaces of the borehole interval. On the other hand, if the depicted borehole interval is significantly inclined from the vertical, FIG. 3A instead shows a typical situation when the rotation of the MWD apparatus 10 has brought the modified blade 22 of the stabilizer 21 which is facing the radiation sensor 28 into contact with the lowermost wall surface of a substantially-circular inclined interval of the borehole 17.

It will be recognized that, as illustrated in FIG. 3A, so long as the MWD apparatus 10 of the present invention is situated in a substantially-circular interval of the borehole 17, the detector 28 will be rotating in a concentric circular path which is substantially the same distance from the borehole wall regardless of the azimuthal orientation of the tool. Since the detector 28 and the gamma source 33 are directionally sensitive, the count rates provided by this detector over any given time period are, therefore, representative of the gamma intensity that is returning from the adjacent sectors of the formations that are lying directly ahead of the gamma detector as it is being rotated during that period. In practicing the present invention, it is important to sample the count rates at a frequency which is sufficiently high to allow variations in the successive count rates to be measured. Accordingly, since drill strings are typically rotated at a speed of somewhere between one and four revolutions/second, these count rates should be measured at sampling rates that are at least twice as fast as the highest frequency of the variation. This requires, therefore, sampling rates which, as a minimum, are eight times per second. Thus, in a preferred manner of practicing the invention, the detector 28 is sampled about ten times per second. This will, of course, require using discrete sampling intervals in the order of 0.1-second for the radiation detector 28. To assure that meaningful output data will be obtained, the complete circumference of the borehole 17 must be scanned at least once during a given sampling period.

Thus, as graphically depicted in FIG. 3B, at each successive sampling interval, $N_1$, $N_2$, $N_3$. . . $N_x$, the gamma detector 28 produces output count rates, as at 50, which are proportionally representative of the level of gamma intensity returning from the circumferentially-spaced sectors of the earth formation which are successively faced by the gamma detector as it is scanning the circumference of the borehole 17. If the earth formation surrounding that particular borehole interval is homogeneous, the series of output count rates should, of course, be substantially equal at each sampling interval. Moreover, in view of the small lateral space between the outward edge of the stabilizer blade 22 and the wall of the substantially-circular borehole 17, any drilling fluid that may be in this clearance space will have only a minor influence on these count rates; and this minor influence will, of course, be substantially constant during the discrete sampling intervals $N_1, N_2, N_3 \ldots N_x$.

In keeping with the principles of the invention, it must be understood that when the MWD apparatus 10 is operating in a substantially-circular borehole penetrating a homogeneous earth formation, theoretically it would be expected for the count rate, as at 50, in each of the successive sampling intervals, $N_1, N_2, N_3 \ldots N_x$ to be equal. Nevertheless, as graphically depicted in FIG. 3B, in practicing the invention, typically there will be slight statistical variations, as at 51, in the measured count rate, as at 50, for each sampling interval.

Turning to FIG. 3C, the distribution of count rates when the density-measuring tool 10 is rotated for a finite period of time in a homogenuous formation is graphically portrayed as a bell curve 52 distributed uniformly around the mean average of the count rates, $X_{mean}$, obtained in N samples taken in that time period. As previously described, it is preferred to take those data samples over intervals of 0.1-second. Using these samples, the mean count rate, $X_{mean}$, and the measured standard deviation, $SD_{measured}$, over a finite sampling period can be calculated from the following equations:

$$X_{mean} = \left[ \frac{\sum_{i}^{N} Xi}{N} \right] \quad \text{(Equation 1)}$$

$$SD_{measured} = \left[ \frac{\sum_{i}^{N} X_i^2 - \left( \sum_{i}^{N} Xi \right)^2}{N-1} \right]^{\frac{1}{2}} \quad \text{(Equation 2)}$$

where

N = Number of 0.1-sec. samples in a given sampling period and $X_i$ = Number of counts measured in each 0.1-sec. sample It should be recognized that the practice of the invention is not limited to the computational technique defined in Equation 2; but as will subsequently be described by reference to FIG. 5, the use of Equation 2 for calculating standard deviation will greatly facilitate the design and operation of the electronic circuitry for the new and improved MWD tool 10.

As seen in FIG. 3C, for a given number of samples, N, taken over a given sampling period, it can be reasonably expected that, as represented by the bell curve 52, the count rates will be symmetrically distributed on opposite sides of a vertical axis representing the mean count rate, $X_{mean}$, as may be determined by the above-described Equation 1. Moreover, it can be reasonably assumed that any deviations from these count rates measured during a given sampling period may be determined readily by a typical statistical deviation formula such as the computational technique defined in the above-described Equation 2.

Figure 4A:
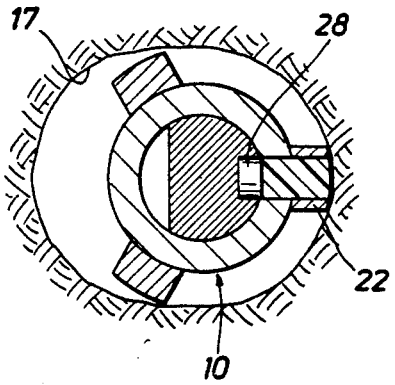
FIG. 4A is a cross-sectioned plan view of the MWD tool and the borehole respectively taken along the Lines A—A in FIG. 2 which is similar to FIG. 3A but instead illustrates the MWD tool while it is rotating in an interval of the borehole having an irregular or non-circular transverse cross-section.

It should, of course, be appreciated that in many cases the MWD apparatus 10 will not be operating in a substantially-circular borehole interval. Accordingly, FIG. 4A is a cross-sectional view of the MWD apparatus 10 taken along the Lines A—A of FIG. 2 for schematically depicting the MWD apparatus as it is rotated in a non-circular interval of the borehole 17 which is shown as having a greater dimension along a major axis than its transverse dimension along its perpendicularly-intersecting minor axis. It must, however, be recalled that since the present invention is independent of borehole inclination, FIG. 4A shows a typical situation where the MWD apparatus 10 is operating in an irregular or non-circular interval of the borehole 17. If this depicted borehole interval of the borehole 17 is vertical, then FIG. 4A simply shows the situation when the rotation of the MWD apparatus 10 has brought the selected stabilizer blade 22 that faces the radiation sensor 28 into contact with one side of a non-circular borehole interval of the borehole 17.

On the other hand, if the MWD apparatus 10 is instead in a borehole interval that is substantially inclined from the vertical, FIG. 4A depicts the situation when the outward edge of the selected stabilizer blade 22 facing the gamma detector 28 has been rotated into contact with the lower wall of the borehole interval with the result that the other blades of the stabilizer 21 are not contacting the higher walls of that borehole interval. It will be appreciated that as the MWD apparatus 10 continues to be rotated, the selected stabilizer blade 22 will be carried out of contact with the borehole wall as it rotates to other angular positions within the borehole interval. Thus, so long as the MWD apparatus 10 remains in a non-circular borehole interval, the stabilizer blade 22 facing the detector 28 will be cyclically moved into momentary engagement with the lowermost wall of the borehole 17 and then rotated to still other angular orientations where the outward edge of this blade is momentarily spaced away from the higher borehole walls.

Figure 4B:
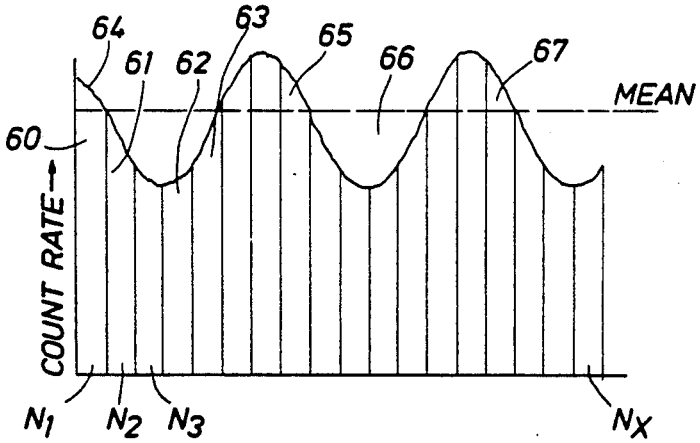
FIG. 4B graphically depicts count rate measurements as will be typically produced by the directional sensor as it is rotated to successive angular positions in the irregular borehole interval shown in FIG. 4A.

Accordingly, when the MWD apparatus 10 is situated in a non-circular interval of the borehole 17, the detector 28 will be rotating in a circular path which is eccentered relative to the borehole axis. Hereagain, since the detector 28 and the gamma source 33 are directionally sensitive, the count rates provided by the detector over any given sampling period are, therefore, affected by the magnitude of backscattered gamma rays returning from the drilling fluid as well as the adjacent sectors of the formation that are lying directly ahead of the gamma detector at that given time. Thus, as is graphically depicted in FIG. 4B, as the drill string 11 is rotated, at each successive sampling interval, $N_1, N_2, N_3 \ldots N_x$, the gamma detector 28 will produce a series of successive output count rates, as at 60–63, that are proportional to the amount of gamma intensity returning from a plurality of circumferentially-spaced sectors of the formation 18 around the borehole 17 as well as from the drilling fluid in that borehole interval as well. If the earth formation surrounding that particular borehole interval is homogeneous, those portions of the count rates which are attributable to the formation density will, of course, remain substantially constant during this particular sampling interval. In this way, it can be reasonably assumed, therefore, that any variations in excess of what is predicted by normal statistical variations in the count rate obtained during a given sampling interval, $N_1, N_2, N_3 \ldots N_x$, are directly attributable to the influence of the drilling fluid that is present in the space between the wall surfaces of the borehole interval and the outward edge of the stabilizer blade 22 during that particular sampling interval.

Accordingly, in keeping with the principles of the invention, it should be understood that when the MWD apparatus 10 is operating in a non-circular borehole interval in a homogeneous earth formation, in addition to the usual statistical variations in the measured count rates as previously described by reference to FIGS. 3B and 3C, it can be reasonably expected that there will be significant variations in the count rates that are related to the lateral distance between the outward edge of the selected stabilizer blade 22 and the adjacent borehole wall surfaces during a given sampling period. Thus, as graphically depicted in FIG. 4B, in practicing the present invention, the rotation of the MWD apparatus 10 will bring about significant modulated variations, such as indicated at 64–67, (both negative and positive) in the measured count rates for each of the several sampling intervals, $N_1$, $N_2$, $N_3$. . . $N_x$, during that particular measuring period.

Figure 4C:
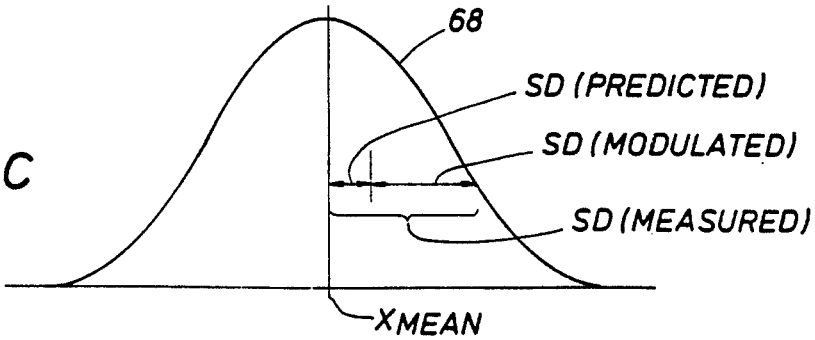
FIG. 4C graphically portrays the distribution of the count rates that would be typically expected in the practice of the present invention when the MWD tool is being rotated in the irregular borehole depicted in FIG. 4A.

Turning to FIG. 4C, the distribution of the count rates which are measured when the density-measuring tool 10 is rotated for a finite period of time in a non-circular interval of a borehole penetrating a homogenuous formation is graphically portrayed as a wide bell curve 68 distributed uniformly around the mean average of the count rates, $X_{mean}$, obtained in N samples taken during that measuring period. Using these samples, the mean count rate $X_{mean}$ and the standard deviation $SD_{measured}$ over a finite sampling period can be calculated from Equations 1 and 2 in the manner as described above. As seen in FIG. 4C, for a given number of N samples taken over a given sampling period, it can again be reasonably expected that, as represented by the depicted wider bell curve 68, the count rates will be distributed on opposite sides of a vertical axis $X_{mean}$ which is determined by the above-described Equation 1. Moreover, it can again be reasonably assumed that any deviations from these count rates during that sampling period may be readily determined by a typical formula such as Equation 2.

In keeping with the principles of the invention, it may be assumed that (as indicated by the bell curve 68 in FIG. 4C), the measured standard deviation, $SD_{measured}$, of the distribution the measured standard deviation, $SD_{measured}$, of the distribution of count rates is comprised of: (1) the predictable part of the count rate variation (i.e., $SD_{predicted}$ which is equal to the square root of $X_{mean}$) as well as (2) an additional part of the count rate variation which comes about or is attributable solely to the modulation of the detector count rate signal (such as shown at 64–67 in FIG. 4B) that is the result of the rotation of the directional detector 28 and the directional source 33 past washouts or irregular transverse cross-sectional configurations in that particular interval of the borehole 17.

Accordingly, it has been found that this relationship can be mathematically expressed by the following equation:

$$(SD_{measured})^2 = (SD_{predicted})^2 + (SD_{modulated})^2 \qquad \text{(Equation 3)}$$

It will be appreciated, therefore, that whenever the drill string 11 is not rotating, the value of $SD_{modulated}$ will become zero so that the measured standard deviation, $SD_{measured}$, will be equal to the predicted standard deviation, $SD_{predicted}$. In a similar fashion, whenever the MWD apparatus 10 of the present invention is rotating in a substantially-circular interval of the borehole 17, the value of $SD_{modulated}$ will likewise approach or equal zero so that the measured standard deviation, $SD_{measured}$, will again closely approximate or become equal to the predicted standard deviation, $SD_{predicted}$.

In keeping with the principles of the invention, when the mud density is less than the formation density, in general it may be assumed that the count rate $X_{mean} - SD_{modulated}$ will at edge of the selected stabilizer blade 22 is close to or is in contact with the exposed face of the adjacent formation 18. As a result, it can be reasonably presumed that the count rate $X_{mean} - SD_{modulated}$ will closely approximate the count rate which is representative of the density of the adjacent earth formation 18. Conversely, in the practice of the invention, it may be generally assumed that the count rate $X_{mean} + SD_{modulated}$ will be directly influenced by the density of the drilling fluid in the borehole interval at that time; and, therefore, it can also be reasonably presumed that this latter count rate is representative of the extent of any lateral spacing that may exist between the outward edge of the stabilizer blade 22 and the formation face.

On the other hand, in those rare occasions when the mud density is greater than the formation density, it may be assumed that the count rate $X_{mean} + SD_{modulated}$ will at least closely correspond to the count rate whenever the outward edge of the selected stabilizer blade 22 is close to or is in contact with the exposed face of the adjacent formation 18. As a result, it can be reasonably assumed that the count rate $X_{mean} + SD_{modulated}$ will closely approximate the count rate which is representative of the density of the adjacent earth formation 18. Conversely, in the practice of the invention, it may be assumed that the count rate $X_{mean} - SD_{modulated}$ will be directly influenced by the density of the drilling fluid in the borehole interval at that time; and, therefore, it can also be reasonably presumed that this latter count rate is representative of the extent of any lateral spacing that may exist between the outward edge of the stabilizer blade 22 and the formation face.

Thus, it will be appreciated that in a borehole interval with irregular transverse geometry, the arithmetical sum of these count rate variations (i.e., $2 \times SD_{modulated}$) will be proportionally representative of the lateral clearance spacing which is then existing between the borehole wall and the outward edge of the stabilizer blade 22 even when the density of that drilling fluid is not known. Therefore, as a minimum, those with skill in the art will, of course, appreciate that any increases in the arithmetical sum of these count rate variations during a drilling operation with the new and improved MWD apparatus 10 of the present invention will typically indicate that the apparatus is beginning to move into an irregular borehole interval or into an enlarged-diameter borehole interval.

Accordingly, it will be appreciated that the count rate variations can be utilized to determine the borehole measurements when the density of the drilling fluid in the borehole 17 can be estimated or determined in some manner such as by using measuring sensors on the MWD apparatus 10 or else by periodically measuring the density of successive samples of the drilling fluid returning to the surface. If the density of that drilling fluid can be adequately measured, calibration curves can be prepared under known laboratory conditions and readily employed in conjuction with the total count variation ($2 \times SD_{modulated}$) in any given sampling period for providing a fairly-accurate estimate of the maximum borehole diameter during the course of the drilling operation. Thus, whenever there is very little variation of the measured count rates, as at 50, which are obtained during the practice of the methods of the present invention, it may be reasonably assumed that the diameter of the borehole interval in which the MWD apparatus 10 is then operating will be very close to the overall diameter of the modified stabilizer 21 and that this particular interval is substantially circular.

Figure 5:
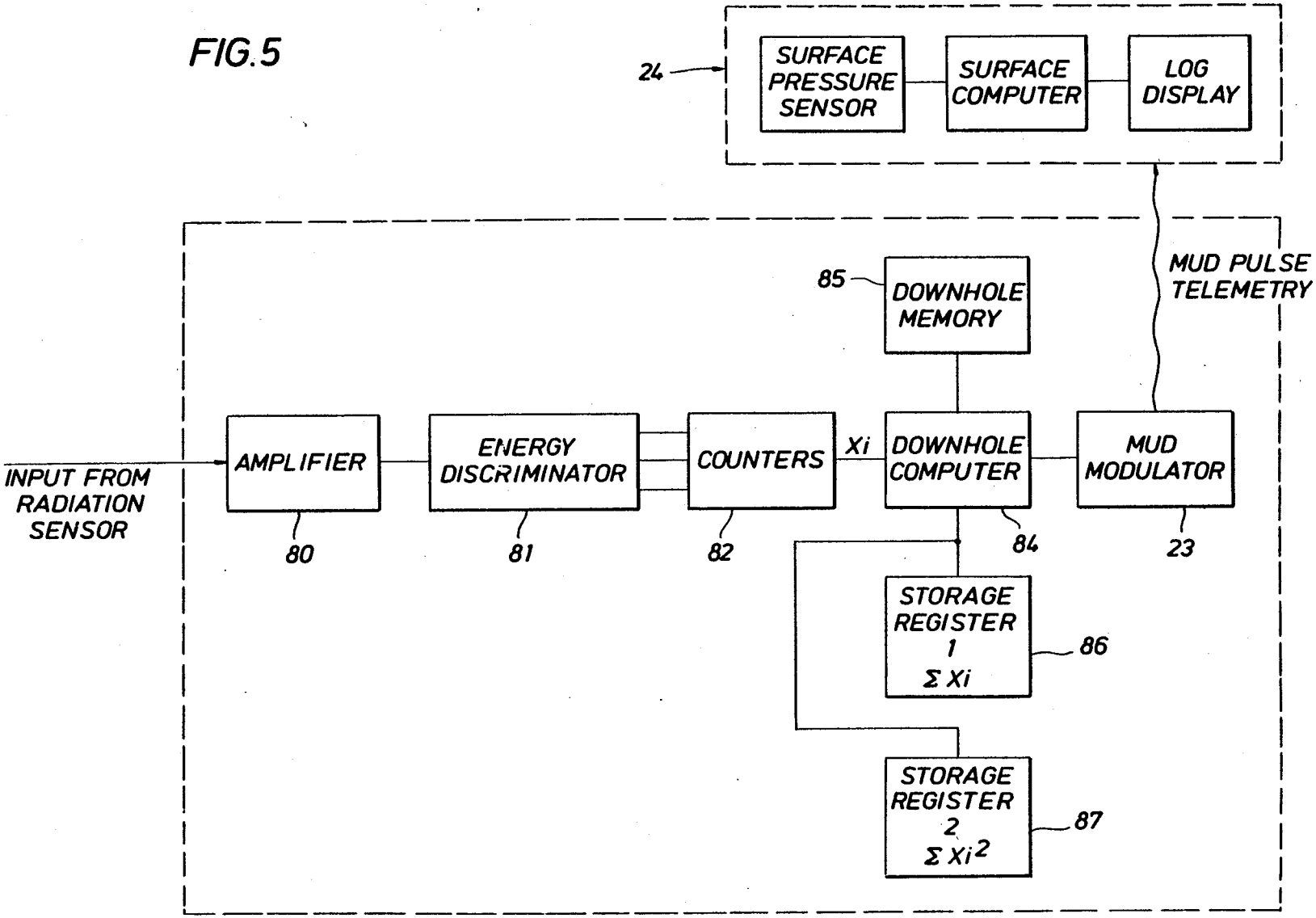
FIG. 5 is a block diagram schematically depicting a preferred embodiment of downhole and surface signal-processing circuitry for practicing the methods of the present invention.

Turning now to FIG. 5, a preferred embodiment is seen of downhole and surface signal-processing circuitry for the MWD apparatus 10 of the present invention which is suitably arranged for practicing the methods of the present invention. As depicted by the block diagram in FIG. 5, the typical downhole circuitry for the new and improved MWD apparatus 10 of the invention is preferably arranged for carrying out computations in accordance with Equation 4 to conveniently accumulate data measured during any sample interval in such a manner that there is a significant reduction in the amount of memory required for the downhole circuitry and, thereby, a corresponding simplification of the downhole circuitry. Accordingly, the output of the detector 28 is coupled by a typical amplifier 80, energy discriminator 81 and counters 82 to input the counts, $X_i$, from that detector to a downhole computer 84 having a memory 85 and a pair of storage registers 86 and 87.

As represented in FIG. 5, it is not necessary to keep each sample of data in order to calculate the mean and standard deviation at the end of a given time period (e.g., a period of 10-seconds) that may be selected as being a typical accumulation period. With the illustrated circuitry, all that is necessary is to employ the register 86 to keep the running sum of the counts from each sample period (i.e., the summation of counts $X_i$) and to employ the register 87 to keep the running sum or overall total of the squares of the counts from each sample period (i.e., the summation of the squares of those counts, $(X_i)^2$. Those skilled in the art will, of course, recognize that this arrangement of these two storage registers 86 and 87 is very efficient in terms of the minimal memory requirements for the downhole memory 85. As illustrated in FIG. 5, the output of the downhole computer 84 is suitably coupled to the acoustic data-signalling means 24 for transmitting the real-time output measurements to the surface circuitry 24 where they may be processed along with the real-time signals from other downhole sensors (not shown) included in the MWD tool 15. As previously mentioned, it will, of course, be recognized that the output from the computer 84 can alternatively be stored in a downhole memory or recorder until such time that the drill string 11 is removed from the borehole 18 and the data is appropriately processed at the surface.

Accordingly, it will be appreciated that the new and improved methods and MWD apparatus 10 of the present invention provide methods and apparatus which are capable of accurately measuring the bulk density of earth formations while a borehole is being drilled through those formations. The new and improved MWD apparatus 10 includes at least one radiation sensor which is directionally responsive along an outwardly-directed response axis. Upon rotation of the MWD apparatus in a borehole interval, this directional sensor successively scans circumferentially-spaced sectors of the adjacent borehole surfaces for providing a series of output signals representative of the bulk density of the adjacent earth formations. The present invention includes data-processing methods and apparatus which are responsive to these output signals for determining the mean average of those successive signals as well as their standard deviation and then combining their resulting mean average and standard deviation to provide measurements which are representative of the bulk density and are uniquely corrected to take into account variations in the transverse cross-sectional configuration of the borehole as well as any significant irregularities on the sidewall surfaces of the borehole.

While only a particular embodiment of the apparatus of the present invention and one preferred mode for practicing the invention have been shown and described, it is apparent that various changes and modifications may be made thereto without departing from the broader aspects of this invention; and, therefore, the aim in the appended claims is to cover all changes and modifications that fall within the true spirit and scope of the methods and apparatus of this invention.

What is claimed is:

1. A method for determining at least one characteristic of an earth formation penetrated by a borehole and irradiated by radiation and comprising the steps of:

positioning a directional radiation sensor in said borehole adjacent to said irradiated formation and rotating said radiation sensor for obtaining a series of successive measurements that are representative of the radiation returning from circumferentially-spaced locations around said borehole;

determining the mean as well as the measured standard deviation of said series of successive measurements; and correlating said mean and said measured standard deviation of said successive measurements for providing indications which are representative of said one formation characteristic as well as the transverse cross-sectional configuration of said borehole.

2. The method of claim 1 further including the step of:

positioning a source of nuclear radiation in said borehole adjacent to said radiation sensor for irradiating said formation before said successive measurements are obtained.

3. The method of claim 2 wherein said successive measurements are obtained as said borehole is drilled into said formation.

4. The method of claim 1 wherein said correlating step includes the steps of:

determining the square root of said mean of said successive measurements;

comparing said square root of said mean of said successive measurements with said measured standard deviation of said successive measurements; and selectively providing a first characteristic indication that said borehole has a substantially-circular transverse cross-sectional configuration when said square root of said mean is substantially equal to said measured standard deviation and selectively providing a second characteristic indication that said borehole has an irregular transverse cross-sectional configuration when said square root of said mean is substantially different from said measured standard deviation.

5. The method of claim 1 further including the steps of:

positioning a directional source of nuclear energy in said borehole adjacent to said radiation sensor; and rotating said directional source for successively irradiating circumferentially-spaced sectors of said formation before said successive measurements are obtained.

6. The method of claim 1 further including the steps of:

positioning a directional source of nuclear energy in said borehole adjacent to said radiation sensor; and simultaneously rotating said directional source and radiation sensor for obtaining said successive measurements.

7. The method of claim 6 wherein said successive measurements are obtained as said borehole is drilled into said formation.

8. The method of claim 7 further including the step of:

transmitting data signals representative of said successive measurements to the surface during the drilling operation.

9. The method of claim 7 further including the steps of:

determining the square root of said mean of said successive measurements;

comparing said square root of said mean with said measured standard deviation of said successive measurements; and providing an indication that the interval of said borehole that is being drilled has a substantially-circular transverse cross-sectional configuration whenever the square root of said mean of said successive measurements is substantially equal to said measured standard deviation of said successive measurements.

10. The method of claim 9 further including the step of:

during the drilling operation, storing in a downhole memory at least some of said successive measurements as well as said indication that the interval of said borehole that is being drilled has a substantially-circular transverse cross-sectional configuration.

11. The method of claim 9 further including the step of:

during the drilling operation, transmitting data signals to the surface representative of said successive measurements as well as said indication that the interval of said borehole that is being drilled has a substantially-circular transverse cross-sectional configuration.

12. The method of claim 7 further including the steps of:

determining the square root of said mean of said successive measurements;

comparing said square root of said mean with said measured standard deviation of said successive measurements; and providing an indication that the interval of said borehole that is being drilled has a substantially-irregular transverse cross-sectional configuration whenever the square root of said mean is substantially different from measured standard deviation of said successive measurements.

13. The method of claim 12 further including the step of:

during the drilling operation, storing in a downhole memory at least some of said successive measurements as well as said indication that the interval of said borehole that is being drilled has a substantially-irregular transverse cross-sectional configuration.

14. The method of claim 12 further including the step of:

during the drilling operation, transmitting data signals to the surface representative of said successive measurements as well as said indication that the interval of said borehole that is being drilled has a substantially-irregular transverse cross-sectional configuration.

15. A method for determining at least one characteristic of an earth formation penetrated by a borehole and comprising the steps of:

coupling a laterally-directed gamma-ray sensor in a drill string;

lowering said drill string into said borehole for positioning said gamma-ray sensor adjacent to said earth formation;

rotating said drill string for rotating said gamma-ray sensor adjacent to said earth formation for obtaining a series of measurements representative of the gamma rays entering said borehole from azimuthally-spaced sectors of said earth formation; determining the mean as well as the measured standard deviation of said gamma-rays entering said borehole from said earth formation; and correlating said mean with said measured standard deviation for providing distinctive indications representative of said one characteristic of said earth formation as well as the transverse cross-sectional configuration of said borehole adjacent to said earth formation.

16. The method of claim 15 wherein said series of measurements are obtained after said borehole has been drilled into said earth formation.

17. The method of claim 15 further including the steps of:

positioning a source of gamma-ray energy adjacent to said gamma-ray sensor for irradiating said earth formation while said drill string is rotating said gamm-ray sensor adjacent to said earth formation to obtain said measurements as well as to provide said distinctive indications.

18. The method of claim 17 wherein said measurements are obtained while said borehole is being drilled into said earth formation.

19. The method of claim 18 further including the step of:

during the drilling operation storing in a downhole memory a first set of data signals representative of at least some of said measurements and a second set of data signals representative of at least some of said distinctive indications.

20. The method of claim 18 further including the step of:

during the drilling operation transmitting to the surface a first set of data signals representative of at least some of said measurements and a second set of data signals representative of said distinctive indications.

21. A method for determining at least the bulk density of an earth formation penetrated by a borehole and comprising the steps of:

coupling a laterally-directed gamma-ray sensor and a laterally-directed gamma-ray source in a drill string;

lowering said drill string into said borehole for positioning said gamma-ray sensor and said gamma-ray source in a borehole interval adjacent to said earth formation;

rotating said drill string for rotating said gamma-ray sensor and said gamma-ray source in said borehole interval as said earth formation is irradiated by said gamma-ray source for obtaining a series of measurements representative of the back-scattered gamma rays returning to said borehole interval from azimuthally-spaced sectors of said earth formation;

determining the mean as well as the measured standard deviation of said returning back-scattered gamma-rays; and correlating said mean with said measured standard deviation for providing distinctive indications representative of said bulk density of said earth formation as well as the transverse cross-sectional configuration of said borehole interval.

22. The method of claim 21 wherein said measurements are obtained while said borehole interval is being drilled in said earth formation.

23. The method of claim 22 further including the step of:

storing in a downhole memory data signals representative of at least some of said distinctive indications while said borehole interval is being drilled in said earth formation.

24. The method of claim 22 further including the step of:

transmitting data signals representative of said distinctive indications to the surface while said borehole interval is being drilled in said earth formation.

25. The method of claim 22 where said correlating step includes the steps of:

determining the square root of said mean of said returning back-scattered gamma rays;

comparing said square root with said measured standard deviation of said returning back-scattered gamma rays; and selectively providing a first distinctive indication that said borehole interval has a substantially-circular transverse cross-sectional configuration when said square root of said mean is substantially equal to said measured standard deviation and selectively providing a second distinctive indication that said borehole interval has an irregular transverse cross-sectional configuration when said square root of said mean is substantially different from said measured standard deviation.

26. The method of claim 22 where said correlating step includes:

determining the square root of said mean of said returning back-scattered gamma rays;

comparing said square root with said measured standard deviation of said returning back-scattered gamma rays; and whenever said square root is substantially equal to said measured standard deviation, providing an indication that said borehole interval that is then being drilled has a substantially-circular transverse cross-sectional configuration.

27. The method of claim 26 further including the step of:

transmitting data signals to the surface representative of said measurements as well as data signals representative of said indication that said borehole interval has a substantially-circular transverse cross-sectional configuration.

28. The method of claim 26 further including the step of:

storing in a downhole memory at least some of said measurements as well as said indication that said borehole interval has a substantially-circular transverse cross-sectional configuration.

29. The method of claim 22 where said correlating step includes:

determining the square root of said mean of said returning back-scattered gamma rays;

comparing said square root with said measured standard deviation of said returning back-scattered gamma rays; and whenever said square root is substantially different from said measured standard deviation, providing an indication that said borehole interval that is then being drilled has a substantially-irregular transverse cross-sectional configuration.

30. The method of claim 29 further including the steps of:

transmitting data signals to the surface representative of said measurements as well as data signals representative of said indication that said borehole interval has a substantially-irregular transverse cross-sectional configuration.

31. The method of claim 29 further including the steps of:

storing in a downhole memory at least some of said measurements as well as said indication that said borehole interval has a substantially-irregular transverse cross-sectional configuration.

32. A method for determining at least one geometrical parameter of a borehole in an earth formation irradiated by radiation and comprising the steps of:

positioning a directional radiation sensor in said borehole adjacent to said irradiated formation and rotating said radiation sensor for obtaining a series of successive measurements that are representative of the radiation returning from circumferentially-spaced locations around said borehole;

determining the mean as well as the measured standard deviation of said series of successive measurements; and correlating said mean and said measured standard deviation of said successive measurements for determining at least one geometrical parameter representative of the transverse cross-sectional configuration of said borehole.

33. The method of claim 32 further including the step of:

positioning a source of nuclear radiation in said borehole adjacent to said radiation sensor for irradiating said formation before said successive measurements are obtained.

34. The method of claim 32 wherein said successive measurements are obtained as said borehole is drilled into said formation.

35. The method of claim 32 wherein said correlating step includes the steps of:

determining the square root of said mean of said successive measurements;

comparing said square root of said mean of said successive measurements with said measured standard deviation of said successive measurements; and selectively providing a first characteristic indication that said borehole has a substantially-circular transverse cross-sectional configuration when said square root of said mean is substantially equal to said measured standard deviation as well as selectively providing a second characteristic indication that said borehole has an irregular transverse cross-sectional configuration when said square root of said mean is substantially different from said measured standard deviation.

36. The method of claim 32 further including the steps of:

positioning a directional source of nuclear energy in said borehole adjacent to said radiation sensor; and rotating said directional source for successively irradiating circumferentially-spaced sectors of said formation before said successive measurements are obtained.

37. Apparatus for determining at least one characteristic of an earth formation penetrated by a borehole and irradiated by radiation and comprising:

a body;

a directional radiation sensor on said body and arranged to be rotated in a borehole for obtaining a series of successive measurements that are representative of radiation returning from circumferentially-spaced locations around the borehole;

circuit means for determining the mean as well as the measured standard deviation of said series of successive measurements;

circuit means for correlating said mean and said measured standard deviation of said successive measurements for providing indications which are representative of said one formation characteristic; and circuit means for providing indications which are representative of the transverse cross-sectional configuration of a borehole in which said apparatus is operating.

38. The apparatus of claim 37 further including:

a source of nuclear radiation cooperatively arranged on said body for irradiating earth formations adjacent to said directional radiation detector.

39. The apparatus of claim 38 further including means for collimating said source of nuclear radiation.

40. Apparatus for determining at least one geometrical parameter of a borehole in an earth formation irradiated by radiation and comprising:

a body;

a directional radiation sensor on said body and arranged to be rotated in a borehole for obtaining a series of successive measurements that are representative of radiation returning from circumferentially-spaced locations around the borehole;

circuit means for determining the mean as well as the measured standard deviation of said series of successive measurements;

circuit means for correlating said mean and said measured standard deviation of said successive measurements for providing indications which are representative of said one formation characteristic; and circuit means for providing indications which are representative of at least one geometrical parameter representative of the transverse cross-sectional configuration of a borehole in which said apparatus is operating.

41. The apparatus of claim 40 further including:

a source of nuclear radiation cooperatively arranged on said body for irradiating earth formations adjacent to said directional radiation detector.

42. The apparatus of claim 41 further including means for collimating said source of nuclear radiation.

43. Apparatus for determining at least one characteristic of an earth formation penetrated by a borehole and comprising:

a body to be coupled into a drill string and lowered into a borehole adjacent to an earth formation;

a laterally-directed gamma-ray sensor arranged on said body to be rotated in a borehole for scanning said gamma-ray sensor around the circumference of a borehole to successively measure the gamma radiation entering a borehole from adjacent earth formations;

circuit means for obtaining a series of successive measurements representative of the gamma rays entering a borehole from azimuthally-spaced sectors of an adjacent earth formation;

circuit means for determining the mean of said successive measurements as well as the measured standard deviation of said successive measurements; and circuit means for correlating said mean of said successive measurements with said measured standard deviation of said successive measurements for providing distinctive indications representative of said one characteristic of an adjacent earth formation as well as the transverse cross-sectional configuration of a borehole in an earth formation.

44. The apparatus of claim 43 further including:

a laterally-directed source of gamma rays cooperatively arranged on said body for irradiating earth formations adjacent to said directional gamma-ray sensor.

45. The apparatus of claim 44 wherein said circuit means for correlating said mean of said successive measurements with said measured standard deviation of said successive measurements further include:

circuit means for determining the square root of said mean of said successive measurements;

circuit means for comparing said square root of said mean of said successive measurements with said measured standard deviation of said successive measurements; and circuit means operable whenever the square root of said mean of said successive measurements is substantially different from said measured standard deviation of said successive measurements for providing an indication that a borehole has a substantially-irregular transverse cross-sectional configuration.

46. The apparatus of claim 45 further including:

memory means for storing a function representative of at least some of said successive measurements as well as said indication.

47. The apparatus of claim 44 wherein said circuit means for correlating said mean of said successive measurements with said measured standard deviation of said successive measurements further include:

circuit means for determining the square root of said mean of said successive measurements;

circuit means for comparing said square root of said mean of said successive measurements with said measured standard deviation of said successive measurements; and circuit means operable whenever said square root of said mean of said successive measurements is substantially equal to said measured standard deviation of said successive measurements for providing an indication that the borehole has a substantially-circular transverse cross-sectional configuration.

48. The apparatus of claim 47 further including:

memory means for storing a function representative of at least some of said successive measurements as well as said indication.

49. The apparatus of claim 43 wherein said circuit means for correlating said mean of said successive measurements with said measured standard deviation of said successive measurements further include:

circuit means for determining the square root of said mean of said successive measurements;

circuit means for comparing said square root of said mean of said successive measurements with said measured standard deviation of said successive measurements; and circuit means selectively operable whenever said square root of said mean of said successive measurements is substantially different from said measured standard deviation of said successive measurements for providing a first distinctive indication that the borehole has a substantially-irregular transverse cross-sectional configuration and selectively operable when said square root of said mean of said successive measurements is substantially equal to said measured standard deviation of said successive measurements for providing a second distinctive indication that the borehole has a substantially-circular transverse cross-sectional configuration.

50. The apparatus of claim 49 further including:

memory means for storing a function representative of at least some of said successive measurements as well as said first and second distinctive indications.

* * * * *